US006623136B1

(12) United States Patent
Kuo

(10) Patent No.: US 6,623,136 B1
(45) Date of Patent: Sep. 23, 2003

(54) PEN WITH LIGHTED SCANNER PEN HEAD AND TWIST SWITCH

(76) Inventor: Chin-Yi Kuo, No. 29, Lane 14, Ho Ping Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 10/145,707

(22) Filed: May 16, 2002

(51) Int. Cl.[7] ..... B43K 29/10

(52) U.S. Cl. ..... 362/118; 362/109; 362/253; 345/183; 401/52; 401/195

(58) Field of Search ..... 362/118, 205, 362/206, 203, 109, 253; 401/29, 30, 32, 33, 52, 195; 345/179, 180, 181, 182, 183, 184

(56) References Cited

U.S. PATENT DOCUMENTS 5,544,967 A * 8/1996 Yao ..... 401/195
5,600,348 A * 2/1997 Bartholow et al. ..... 345/180
5,617,304 A * 4/1997 Huang ..... 362/118
5,717,435 A * 2/1998 Fukushima et al. ..... 345/179
5,803,583 A * 9/1998 Hsieh ..... 401/195
6,099,185 A * 8/2000 Huang et al. ..... 362/118
6,431,720 B1 * 8/2002 Cheng ..... 362/118

* cited by examiner

*Primary Examiner*—Sandra O'Shea
*Assistant Examiner*—John Anthony Ward
(74) *Attorney, Agent, or Firm*—Bacon & Thomas, PLLC

(57) ABSTRACT

A pen with a scanner pen head and a twist switch comprised of a writing pen, an upper penholder section, a twist switch and a light emission device; a chamber containing three gradations in the upper penholder section to receive penetration of a guide pin from a plunger in the upper penholder section with the lower end of the plunger linked to the upper end of the writing pen so to control the plunger to rise to retract or to descend to expose a refill for writing purpose.

8 Claims, 8 Drawing Sheets

PEN WITH LIGHTED SCANNER PEN HEAD AND TWIST SWITCH

BACKGROUND OF THE INVENTION (a) Field of the Invention

The present invention is related to a pen with lighted scanner pen head and a twist switch, and more particularly, to a lighted pen for writing and a scanner for touch screen with its lighting and retractable pen refill controlled by the twist switch.

(b) Description of the Prior Art

A pen generally available in the market is simply for writing purpose. To improve its practicability, a bulb or LED, or red light beam emission device is separately provided to the pen head for the pen to also function as a flashlight, or a scanner for a touch screen from a PDA, or a language translator.

When also functioning as a flashlight, the pen is usually adapted with a twist switch to control on/off of the light, and a press power switch is provided on the upper part of the penholder, or at the pen clip. The structure of such switch is comparatively complicate, particularly in case of a twist pen with a retractable refill since the interior structure plus the press power switch makes the pen in excessively large size, if made.

Furthermore, the scanner incorporated with a conventional writing pen requires an auxiliary lighting fixture when used on a touch screen from a PDA or a language translator, and that prevents precise search for a dialog display on the screen in the absence of external light source.

SUMMARY OF THE INVENTION

The primary purpose of the present invention is to provide a pen with a lighted scanner pen head and a twist switch, essentially comprised of a writing pen, an upper penholder section, a twist switch and an LED. To achieve the purpose, the twist switch is provided with a channel having three gradations extending at a certain slot on the upper penholder section; a plunger is provided inside the upper penholder section by having a guide pin on one side of the plunger to penetrate through and stay in the channel with the lower end of the plunger linked to the upper end of the writing pen; accordingly, the writing pen controls the plunger to rise along the channel to push a conductor, the conductor is then conducted with the LED for the LED to emit the light while the plunger can be controlled by the writing pen to descend along the channel to eject the refill for writing purpose.

Another purpose of the present invention is to provide a pen with a lighted scanner pen head and a twist switch. Wherein, a bulb or an LED is fixed to the upper end of the upper penholder with a conic tip serving as a scanner pen head, also as a lighted writing pen adapted with the twist switch and a plurality cells in the upper penholder. The local lighting facilitates the use of the pen of the present invention in the dark on a touch screen from a PDA or a language translator.

Another purpose yet of the present invention is to provide a pen with a lighted scanner pen head and a twist switch. Wherein, the writing pen relates to a tube having its upper portion formed an insertion section in smaller diameter to receive the insertion of an upper pen holder; a polygonal hole being provide in the upper end of the insertion section to allow the lower end of a plunger from the twist switch to penetrate through the polygonal hole for the writing pen to control the plunger to elevate or descend by twisting, thus the plunger is controlled to either rise along the channel to hold against the conductor or to descend to eject the refill by twisting the writing pen.

DETAILED DESCRIPTION OF THE PREFERRED EMBODIMENTS

Figure 1:
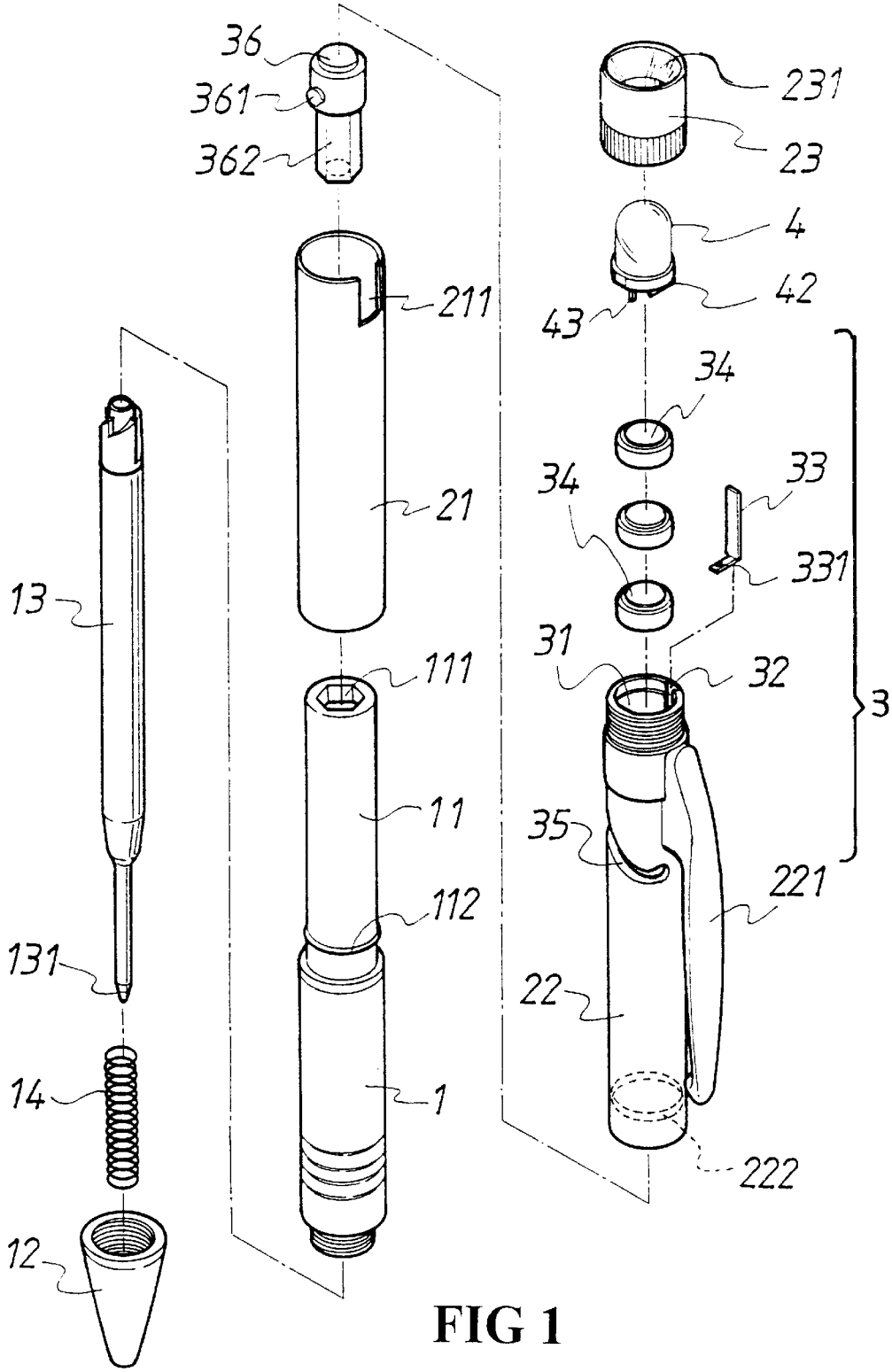
FIG. 1 is a blow-up view of a preferred embodiment of the present invention.

Referring to FIGS. 1, 2, 6 and 7, a preferred embodiment of the present invention of a pen with lighted scanner pen head and a twist switch related to one that operates as a conventional writing pen, also as a scanner for touch screen of a PDA or a language translator, is essentially comprised of a writing pen 1, an upper penholder section 2, a twist switch 3 and a light emission device 4, within:

The writing pen 1 relates to a structure of a writing tool containing a retractable refill; provided in the form of a hollow tube having its upper portion in smaller diameter as a linking section 11, the inner diameter of the linking section 11 being in the form of a polygonal hole 111; one or a plurality of flanges 112 being provided to the peripheral of the linking section 11; a hollow, conic tip 12 being screwed to the lower end of the writing pen 1; a refill 13 and a coil 14 being inserted into the writing pen 1; and the refill 13 being inserted into the coil 14 to allow a pen point 131 of the refill 13 become retractable in the tip 12.

Figure 2:
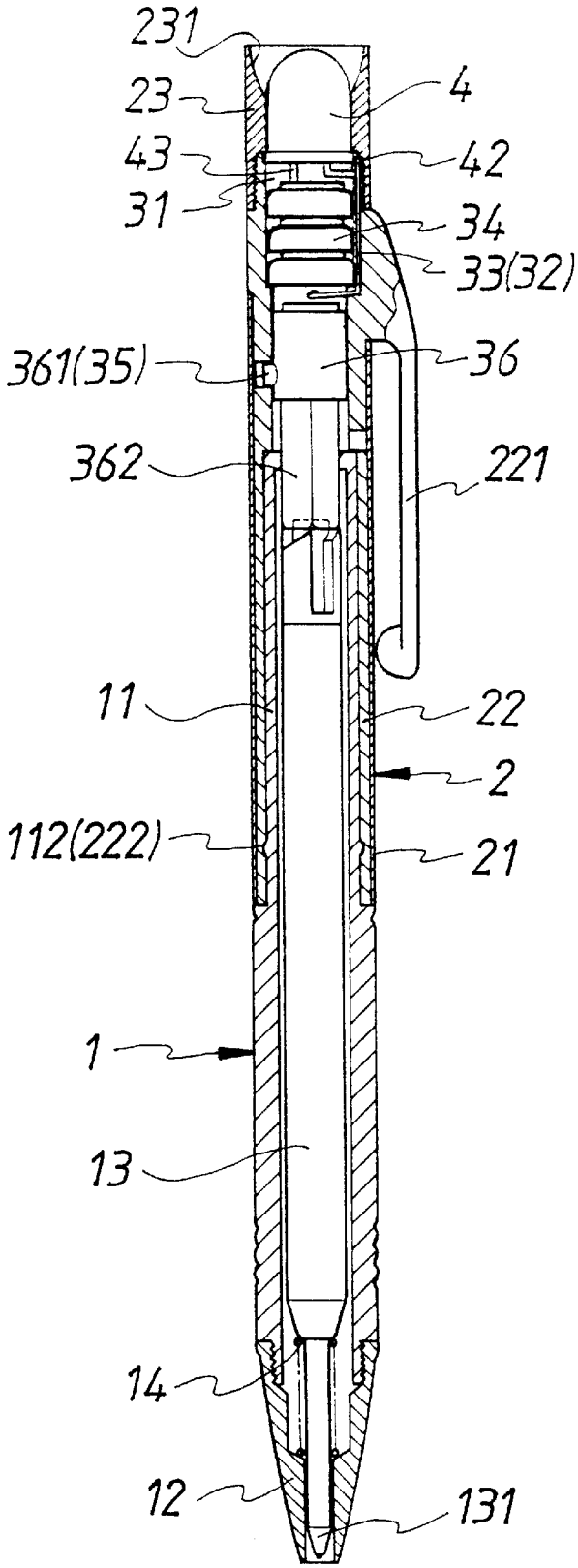
FIG. 2 is a longitudinal section view of the preferred embodiment of the present invention as assembled.
Figure 3:
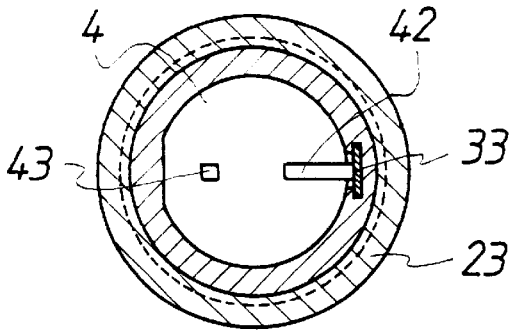
FIG. 3 is a cross section view of the preferred embodiment of the present invention.
Figure 4:
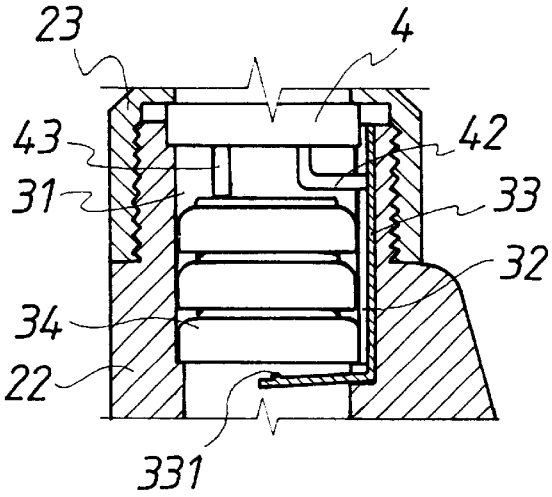
FIG. 4 is a local view showing a twist switch of the preferred embodiment of the present invention.
Figure 5:
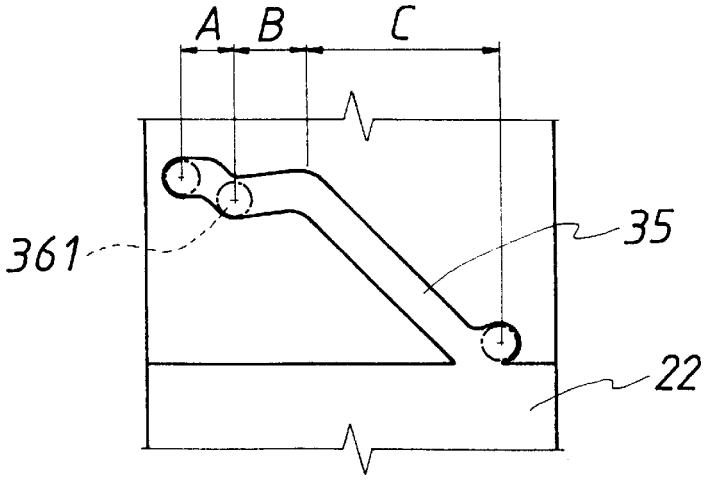
FIG. 5 is a schematic view showing a channel structure of the preferred embodiment of the present invention.
Figure 6:
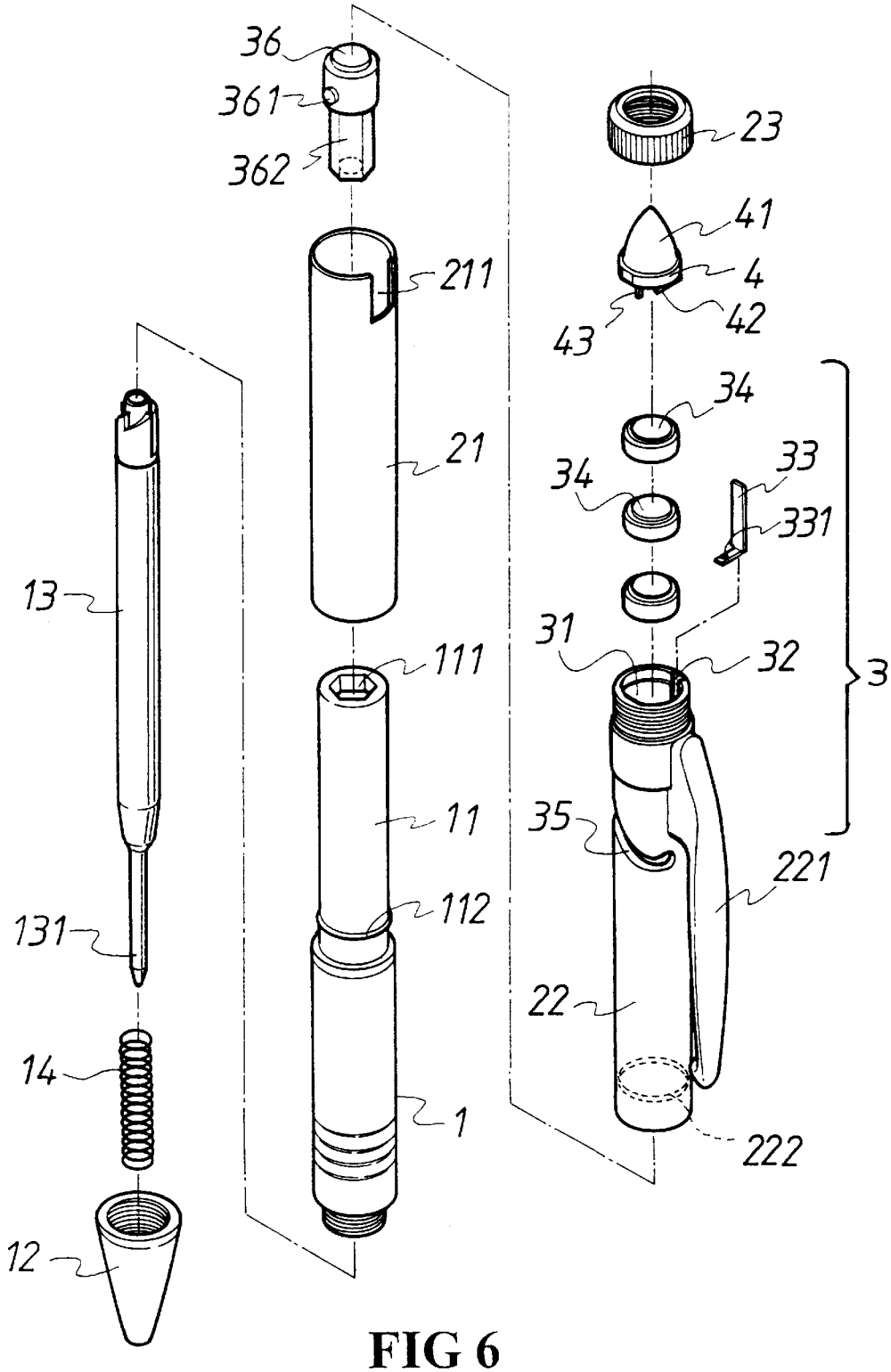
FIG. 6 is a blow-up view of another preferred embodiment of the present invention.
Figure 7:
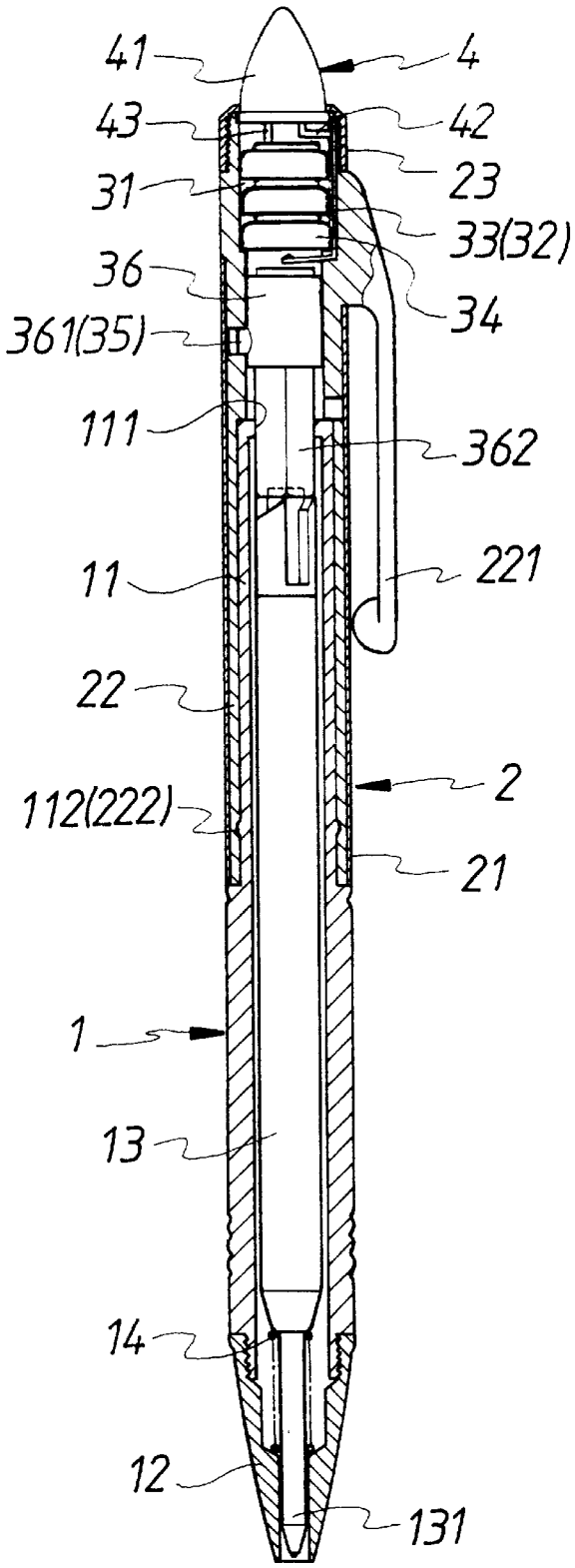
FIG. 7 is a sectional view of another preferred embodiment of the present invention as assembled.
Figure 8:
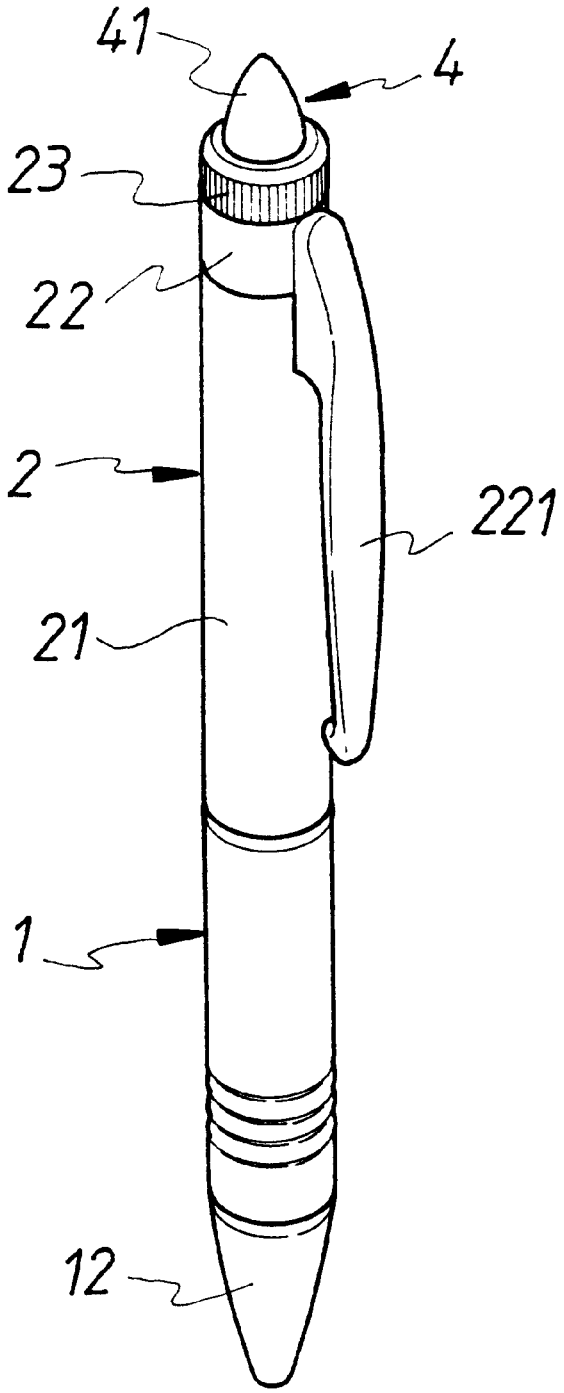
FIG. 8 is a perspective view of another preferred embodiment of the present invention as assembled.

The upper penholder section 2 provided to accommodate the twist switch and the light emission device 4, includes an outer sleeve 21, a hollow upper penholder 22 and a cap 23; the outer sleeve 21 having at its top provided with a caulking gap 211; the upper penholder 22 being adapted to its side a clip 221 and containing inside its lower portion a circular groove 222; the cap 23 either fixed or screwed to the upper end of the upper penholder 22 being further adapted with a conic light convergence mask 231 to focus light source; the upper penholder 22 being inserted into the outer sleeve 21 for the caulking gap 211 to be merely caulked to the root of the clip 221 thus for the upper penholder 22 to be inserted to where the linking section 11 of the writing pen 1 being engaged to the upper penholder section 2 and to make the writing pen 1 to be twistable;

As illustrated in FIGS. 3, 4 and 5, the twist switch 3 is provided on the upper penholder section 2 having provided a chamber 31 in a larger diameter at the top in the upper penholder 22 to accommodate a plurality of mercury cells 34; a standing trough 32 being provided on the side wall in the chamber 31 and an L-shape conductor 33 disposed in the standing trough 32 extending to the upper end of the standing trough 32 and where below the chamber 31 and a nipple 331 being provided at the bottom of the conductor 33 to contact negative electrode of the mercury cell 34; a channel 35 as illustrated in FIG. 5 with three gradations being additionally provided on the side wall of the upper penholder 22 below the chamber 31; a plunger 36 as illustrated in FIG. 2 or 7 being provided in the upper penholder 22 having a guide pin 361 protruding from the side wall of the plunger 36 to penetrated into the channel 35 while a polygonal pillar 362 being extending from the lower end of the plunger 36 for the plunger 36 to elevate or descend along the channel 35 to control the L-shape conductor 33 to elevate or descend to contact the twist switch 3 for the mercury cells 34 upon turning the plunger 36; and The light emission device 4, as illustrated in FIGS. 1 and 2, related to a transparent or opaque bulb or an LED has provided at its lower end two conductible pins 42, 43; wherein, the pin 42 being folded to extend to another side while the pin 43 indicating straight to constitute an internal lighting for the scanner pen head when both pins 42, 43 being conducted; furthermore, as illustrated in FIGS. 6, 7 and 8, the upper end of the light emission device 4 of the present invention being formed a conic scanner pen head 41 to operate on the touch screen of a PDA or a language translator.

Now referring to FIG. 2 or 7, wherein, the upper penholder section 2 with the lower end of the upper penholder 22 is inserted and restricted in the linking section 11 of the writing pen 1 for the circular groove 222 inside the upper penholder 22 to be caulked to the flange 112 on the writing pen 1 while the polygonal pillar 362 provided to the lower end of the plunger 36 in the upper pen holder 22 is merely inserted into the polygonal hole 111 in the upper end of the linking section 11. As a result, twisting the writing pen 1 controls the plunger 36 of the twist switch 3 to elevate or descend along the channel 35, and prevents the upper penholder 22 from being twisted by having the caulking gap 211 in the outer sleeve 21 to caulk to the root of the pen clip 221. Furthermore, a plurality of mercury cells 34 being placed into the chamber 31 provided at the upper end of the upper penholder 22 and a proper spacing is defined between the nipple 331 on the bottom of the conductor 33 and the negative electrode of the mercury cell 34 so to allow insertion of the light emission device 4 to the upper end of the upper penholder 22, which is then secured by insertion of the cap 23. Meanwhile, the folded pin 42 contacts the conductor 33 while another pin 43 holds against the end of the positive electrode of the mercury cell 34 as illustrated in FIG. 4 for the present invention to also function as a lighted scanner pen head.

Figure 9:
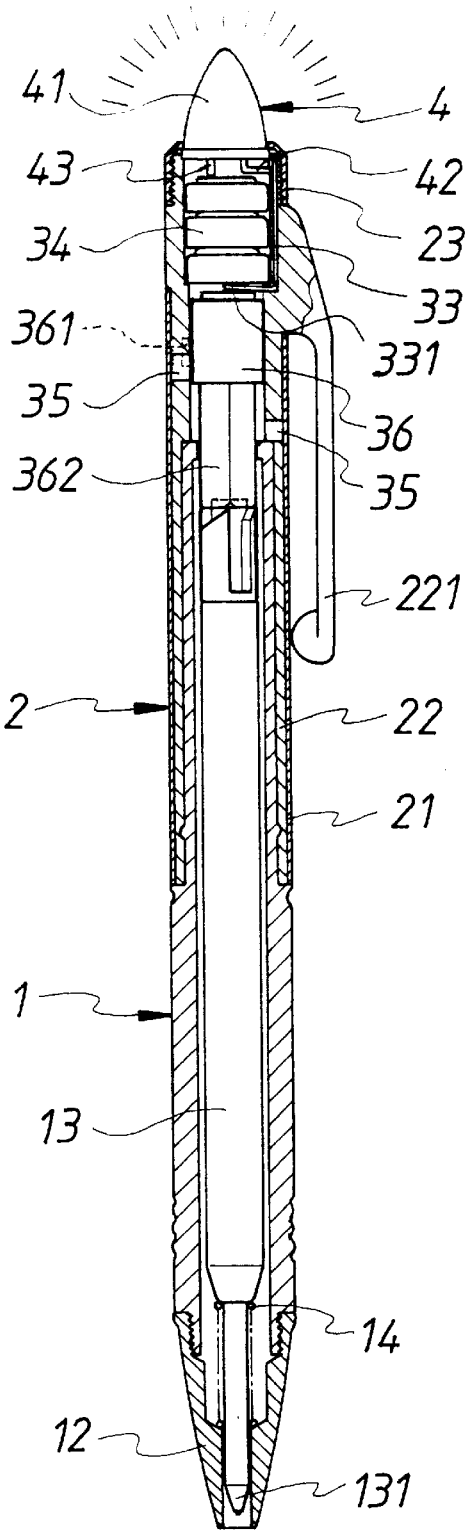
FIG. 9 is a schematic view showing operation of an LED of the present invention.

As illustrated in FIG. 5 and FIG. 9, the present invention is applied as a flashlight or as a scanner pen head on touch screen of a PDA or a language translator in the dark or at night. Wherein, the writing pen 1 is twisted for the plunger 36 of the twist switch 3 to rise from gradation B up to gradation A in the channel 35, to push the L-shape conductor 33 to rise for its nipple 331 to contact the bottom of the cells. In turn, the light emission device 4 is conducted and provides direct lighting for the scanner pen head 41 without depending on external light source to click on the PDA or language translator while working also as a flashlight. On the contrary, when the lighting is not required, just twist the writing pen 1 in reverse for the plunger 36 to step down from gradation A to gradation B in the channel 35, thus to disengage the nipple 331 from the cells, thus to break the circuit of the L-shape conductor 33. The present invention achieves practical effects of easy control by means of the twist switch 3 to select whether the light emission device 4 is needed.

Figure 10:
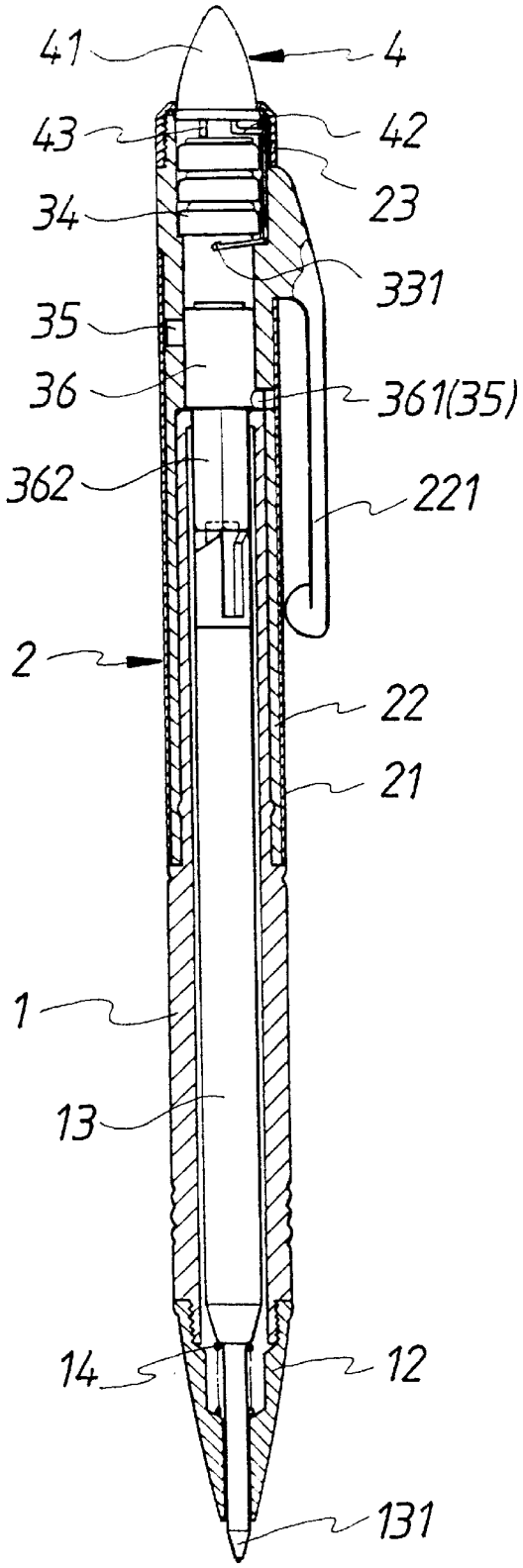
FIG. 10 is a schematic view showing operation of a writing pen of the present invention.

Furthermore, the twist switch 3 of the present invention also controls the refill 13 of the writing pen 1. As illustrated in FIGS. 5 and 10, the writing pen 1 is twisted to drive the plunger 36 to descend from gradation B to gradation C in the channel 35 so that the bottom of the polygonal pillar 362 by the plunger 36 presses against the upper end of the refill 13 inside the writing pen 1 to expose the pen point 131 out of the tip 12 for the present invention to function as a traditional writing pen. Upon completing the writing, the writing pen 1 is twisted in reverse for the plunger 36 to rise from gradation C up to gradation B in the channel 35 to retract the refill 13 by tension from the coil 14 into the tip 12 as illustrated in FIG. 9 to protect the pen point 131.

As disclosed, a pen of the present invention adapted with a lighted scanner pen head and a twist switch achieves its purpose to control the light emission device 4 and the retractable refill 13 in the writing pen 1 by means of the twist switch to effectively eliminates complicate structure, difficulty in assembling and excessive size as found with the prior separately adapted with two switches; and the light emission device 4 provides direct lighting source for the scanner pen point 41 permits the present invention to be applied on the touch screen of information equipment such as a PDA or a language translator in the dark or at night.

What is claimed is:

1. A pen with a scanner pen head and a twist switch, comprised of a writing pen, an upper penholder section, a twist switch and a light emission device; wherein, the writing pen containing a retractable refill for writing purpose and a polygonal hole being provided in its upper end; the upper penholder section accommodating the twist switch and the light emission device;

the twist switch comprised of a chamber provided in the upper end of the upper penholder section to accommodate a plurality of cells, a trough being provided in the side wall of the chamber to contain an L-shape conductor extending to the upper end of the upper penholder section and where below the chamber; a proper spacing being provided between the bottom of the conductor and the bottom of the cells; a plunger inserted into the upper penholder section having on its side wall to protrude a channel containing three gradations extending at a certain slot; a polygonal pillar being adapted to the lower end of the plunger to control the L-shape conductor to rise or to descend to contact or disengage from the cells; and the light emission device having two conductor pins provided at its lower end; characterized by that the upper penholder section being inserted into the upper end of the writing pen; the polygonal pillar at the lower end of the plunger in the upper penholder being inserted into the polygonal hole in the upper end of where the upper penholder section being inserted into the writing pen; the plunger being driven by twisting the writing pen; the light emission device being mounted in the upper end of the upper penholder section for one pin at the bottom of the light emission device to contact the conductor with another pin pressing against the positive electrode of the cell.

2. A pen with a scanner pen head and a twist switch as claimed in claim 1, wherein, the writing pen related to a hollow tube having in its upper portion provided in smaller diameter to receive insertion by the upper penholder where adapted with the polygonal hole; a conic tip provided at its lower end; and the conic containing a coil for a refill to penetrate through and become retractable into and out of the conic tip.

3. A pen with a scanner pen head and a twist switch as claimed in claim 1, wherein, the upper penholder section is comprised of an outer sleeve, a hollow upper penholder and a cap; a caulking trough being provided in the upper end of the outer sleeve; a clip being provided on one side of the upper penholder, a circular cap provided to the upper end of the upper penholder to secure the-light emission device in position; the upper penholder inserted into the outer sleeve for the root of the clip to be merely inserted into caulking trough; and the upper penholder accommodating the twist switch.

4. A pen with a scanner pen head and a twist switch as claimed in claim 3, wherein, a conic convergence light mask is provided inside the front of the cap to converge the light source.

5. A pen with a scanner pen head and a twist switch as claimed in claim 1, wherein, a nipple is provided at the bottom of the L-shape conductor in the twist switch to be conducted when contacting the bottom of the cells.

6. A pen with a scanner pen head and a twist switch as claimed in claim 1, wherein, the light emission device related to a transparent or opaque bulb or LED.

7. A pen with a scanner pen head and a twist switch as claimed in claim 1, wherein, the upper end of the light emission device is made in conic to define a scanner pen point, also functioning as a flashlight when conducted by contacting the cells.

8. A pen with a scanner pen head and a twist switch as claimed in claim 1, wherein, two pins are provided to the lower end of the light emission device with one pin being folded to extend to the other side to contact the L-shape conductor while the other pin being vertical; and the light emission device being adapted in the upper end of the upper pen holder to contact the upper side of the cells.

* * * * *